United States Patent [19]

Garth

[11] 4,038,044

[45] July 26, 1977

[54] GASOLINE ADDITIVE COMPOSITIONS COMPRISING A COMBINATION OF DIAMINE AND POLYAMINE MANNICH BASES

[75] Inventor: Bruce Hollis Garth, Newark, Del.

[73] Assignee: E. I. Du Pont de Nemours and Company, Wilmington, Del.

[21] Appl. No.: 612,727

[22] Filed: Sept. 12, 1975

[51] Int. Cl.[2] ..... C10L 1/22

[52] U.S. Cl. ..... 44/75; 44/72; 44/73

[58] Field of Search ..... 44/72, 75, 73; 252/51.5 A

[56] References Cited

U.S. PATENT DOCUMENTS

| | | | |
|---|---|---|---|
| 3,649,229 | 3/1972 | Otto | 44/73 |
| 3,736,357 | 5/1973 | Piasek et al. | 252/51.5 A |
| 3,877,889 | 4/1975 | Dix | 44/73 |

*Primary Examiner*—Daniel E. Wyman
*Assistant Examiner*—Mrs. Y. Harris-Smith
*Attorney, Agent, or Firm*—James A. Costello

[57] ABSTRACT

A combination of diamine and higher polyamine Mannich condensation products useful in gasoline as carburetor detergents and useful also to control intake valve deposits and quick-heat intake manifold deposits; the diamine being $ZNHC_nH_{2n}NHZ$ and the polyamine being $ZNH(C_xH_{2x}N(R'))_y—C_xH_{2x}NHZ$ wherein Z is an alkyl- and hydroxy-substituted benzyl, the alkyl having 50 to 1000 carbon atoms; R′ is hydrogen or Z with the proviso that at least one R′ is hydrogen; $n$ is 2 to 6; $x$ is 2 or 3; and $y$ is 1 to 5.

10 Claims, No Drawings

GASOLINE ADDITIVE COMPOSITIONS COMPRISING A COMBINATION OF DIAMINE AND POLYAMINE MANNICH BASES

BACKGROUND OF THE INVENTION

This invention concerns gasoline additives which are a combination of a diamine Mannich Base and a polyamine Mannich Base.

The operation of modern internal combustion engines is often made difficult by the accumulation of deposits in critical areas of the fuel intake system. Use of one type of gasoline additive to overcome a particular problem of deposit accumulation may cause certain other difficulties. For instance, carburetor detergents which are usually polar compounds such as amines, amides, amine phosphates, imidazolines and succinimides, may cause an increase in intake value deposits. Intake valve deposit control additives are usually non-polar or low-polar materials such as top cylinder oil and low viscosity hydrocarbon polymers.

Carburetor detergents are believed to function by washing away deposits when liquid gasoline being discharged from the accelerator pump or high speed jet flows past the throttle plate. In a carburetor, such washing away of deposits takes place at relatively low temperatures. In contrast, in the vicinity of the intake valves, the temperature is in the range of 500° to 600° F and the liquid gasoline which participates in the washing operation in the carburetor is largely vaporized by the time it reaches the intake valve.

Concern in controlling motor vehicle exhaust emissions has led to many engine modifications, and to the use of various emission control devices. One proposed solution for minimizing carbon monoxide emissions without engine stalling is to effect better fuel evaporation by the time the choke is off. This is accomplished by having fuel droplets from the carburetor impinge upon a plate heated by hot exhaust gases. The plate is designed to hold the fuel droplets until evaporation takes place. However, one difficulty with such a system, also called Early Fuel Evaporatin (EFE) is that the high boiling ends of the fuel remaining in contact with the hot surface tend to decompose and from deposits. As the deposit accumulation increases, the plate becomes ineffective in vaporizing fuel and thus engine stalling may occur during engine warm-up.

Condensation products of an alkylphenol, an aldehyde, and an amine have been found to be effective carburetor detergents in gasoline. These condensation products are often called Mannich Bases since the reaction by which they are prepared is known as the Mannich reaction. When the amine reactant is a polyalkylenepolyamine and the aldehyde reactant is formaldehyde, the condensation product is a polyamine containing alkyl- and hydroxy-substituted benzyl substituents. Unfortunately, Mannich Bases when used in amounts sufficient to provide carburetor detergency, also cause increased intake valve deposits.

It is an object of this invention, therefore, to provide a multifunctional gasoline additive which is a carburetor detergent and which at the same time minimizes intake valve deposits and quick-heat intake manifold deposits.

SUMMARY OF THE INVENTION

The gasoline additive compositions of this invention comprise a combination of i. from 20 to 80 weight percent of a diamine of the formula $ZNHC_nH_{2n}NHZ$, and ii. from 20 to 80 weight percent of a polyamine of the formula $Z—NH(C_xH_{2x}N(R'))_y—C_xH_{2x}NH—Z$ wherein Z is an alkyl- and hydroxy-substituted benzyl, the alkyl having 50 to 1000 carbon atoms; R' is hydrogen or Z with the proviso that at least one R' is hydrogen, $n$ is 2 to 6; $x$ is 2 or 3; and $y$ is 1 to 5.

Preferred compositions are those wherein Z has 50 to 200 carbon atoms; wherein $n$ is 2; wherein $x$ is 2 wherein $y$ is 1 to 4; wherein (i) constitutes from 60 to 75 weight percent of the combination and (ii) constitutes the balance, i.e. 25 to 40 weight percent. Especially preferred compositions are those wherein Z has 50 to 75 carbon atoms; wherein in Z at least 60% of the alkyl substituent is para to the hydroxyl substituent; wherein $n$ is 2, $x$ is 2 and $y$ is 2 to 3; and wherein each R' = H.

Preferred polyamines are substituted diethylenetriamines, triethylenetetramines and tetraethylenepentamines wherein the substituents are Z groups on the terminal nitrogen atoms and wherein the internal secondary amino groups are unsubstituted. The most preferred polyamines are derived from triethylenetetramine and tetraethylenepentamine, each containing Z groups on the terminal nitrogen atoms and each having unsubstituted internal secondary amino groups. For optimum quick-heat intake manifold deposit control the Z group should have an alkyl substituent of 50 to 200 carbon atoms, more preferably from 50 to 75 carbon atoms, with at least 60% of the alkyl substituent located in the para position relative to the hydroxyl group.

Also included within the scope of this invention are gasoline compositions containing the invention additive. Normally, the gasoline will contain from about 0.004 to 0.1 percent by weight of the invention compositions, i.e., 10 to 250 pounds per thousand barrels (ptb), preferably from about 0.02 to 0.08 weight percent (50 to 200 ptb) and most preferably from about 0.03 to 0.06 weight percent (75 to 150 ptb). The amount will depend upon the particular benefit or combination of benefits desired. At about 0.004 weight percent, benefits of carburetor detergency and control of quick-heat intake manifold deposit are obtained. If control of intake valve deposits is desired, the invention composition should be used in the range of about 0.02 to 0.08 weight percent and more preferably from about 0.03 to 0.06 weight percent. While concentrations greater than 0.1 weight percent are useful, very little additional benefit is obtained. Solution concentrates of the additive compositions are also part of this invention and will be discussed more fully hereafter.

DETAILS OF THE INVENTION

The amines of this invention can be prepared by any method known to those skilled in the art including alkylation of a suitable amine with an alkyl- and hydroxy-substituted benzyl halide. However, the amines are preferably prepared by the well-known Mannich reaction wherein an alkylphenol, a suitable amine, and formaldehyde are mixed together and heated to a temperature sufficient for the reaction to occur from e.g. about 80° to 200° C. While not required, an acidic catalyst such as hydrochloric acid or sulfuric acid can be used. The reaction mixture is kept at the reaction temperature until sufficient water of condensation has been evolved and removed.

The Mannich reaction can be carried out in the absence of a solvent but it is usually best to use one, preferably one which distills with water azeotropically. Suitable solvents are hydrocarbons boiling in the gasoline boiling range of 32° C to 205° C and include hexane, cyclohexane, benzene, toluene, xylene (preferred) and mixtures thereof. The solvent, if used, is present in an amount up to about 90% by weight of the total reaction mixture. The use of a solvent not only facilitates the reaction but some or all of the solvent can be retained in the reaction mixture to facilitate handling and incorporation of the additive composition into gasoline. The solutions will usually contain 10 to 90%, preferably 60 to 80%, and most preferably 40 to 80% by weight of the invention additive in one or more of the solvents listed above.

The alkylphenol useful for the preparation of the compositions of the invention is preferably a monoalkylphenol where the alkyl group has from 50 to 1000 carbon atoms. In the preferred form, at least 60% of the alkyl group is located para to the phenolic hydroxyl group. The presence of minor amounts of di- and trialkylphenols is not objectionable. Alkylation of the phenol with a monoolefin of 50 to 1000 carbon atoms using boron trifluoride catalyst and a reaction temperature of below about 65° C, preferably in the range of 40° to 50° C, is the preferred process for preparing a suitable alkylphenol starting material.

The olefin used to alkylate the phenol will have an average molecular weight of about 700 to 14,000. Preferred are monoolefins containing from 50 to 100 carbon atoms prepared from polymerization of low molecular weight olefins of 2 to 6 carbon atoms either as homopolymers or as copolymers. The most preferred monoolefins are homopolymers of propylene having 50 to 75 atoms.

THE DIAMINE COMPONENT (1)

The diamine component can be a mixture of diamines having the requisite generic formula. Such diamine can be prepared by reacting two molar proportions each of alkylphenol and formaldehyde with one molar proportion of alkylenediamine by the above described Mannich reaction. Useful reactant alkylenediamines include among others ethylenediamine, 1,2-propylenediamine, 1,3-propylenediamine, 1,4-butylenediamine, 1,5-pentylenediamine and 1,6-hexylenediamine. The preferred alkylenediamines are ethylene- and propylenediamines, more preferably ethylenediamine.

THE POLYAMINE COMPONENT (ii)

The polyamine component can be a mixture of polyamines having the requisite generic formula. The polyamine reactant used in the Mannich reaction is an alkylenepolyamine represented by the formula, $H_2N(C_xH_{2x}NH)_yC_xH_{2x}NH_2$, wherein $x$ and $y$ have the same significance as in the generic formula set out above. Thus, the reactant alkylenepolyamine has two primary amino groups and at least one secondary amino group. The reactant alkylenepolyamines are ethylene and propylene polyamines and include diethylenetriamine, triethylenetetramine, tetraethylenepentamine, pentaethylenehexamine, hexaethyleneheptamine, dipropylenetriamine, tripropylenetetramine, tetrapropylenepentamine, pentapropylenehexamine, and hexapropyleneheptamine. When the alkylene group is propylene, it can be either a 1,2- or 1,3-propylene group. The reactant alkylenepolyamines can be prepared by well known methods such as by the reaction of ethylene or propylene dichloride with ammonia. Most of the alkylenepolyamines are commercially availabe.

In preparing the invention polyamine by the Mannich reaction, at least two moles each of alkylphenol and formaldehyde per mole of alkylenepolyamine must be used and the maximum molar ratio of each of alkylphenol and formaldehyde per mole of the reactant polyamine should be one less than the total number of amino groups in the polyamine. To illustrate the reactant proportions when the reactant polyamine is diethylenetriamine (3 amino groups): two moles each of alkylphenol and formaldehyde per mole of polyamine are used. When the reactant polyamine is tetraethylenepentamine (5 amino groups), from 2 to 4 moles each of alkylphenol and formaldehyde per mole of tetraethylenepentamine are used.

The requirement that the invention polyamine should contain at least two alkyl-and hydroxy-substituted benzyl groups and at least one R′ equal to hydrogen is based on the discovery that these parameters are important in controlling deposit formation in quick-heat intake manifolds and in providing satisfactory carburetor detergency.

As recognized by those skilled in the art, in a condensation reaction such as the presently discussed Mannich reaction wherein one of the reactants has multiple reaction sites, although one product can predominate there can also be present other products wherein more or less of the reaction sites have reacted. As an illustration, when four moles each of an alkylphenol as defined and formaldehyde are reacted with one mole of tetraethylene pentamine (having 5 reactive nitrogen atoms) the reaction mixture can also contain some di-, tri- and pentabenzyl compounds in addition to the predominant tetrabenzyl compound. Thus, the reaction mixture can be a complete mixture of variously substituted polyamines but it is believed that the generic formula for the invention polyamine is a fair representation of the condensation product.

The following discussion and experimental data support the attribution to the invention compositions of the various desirable properties heretofore and hereafter pointed out. From the data, one can see the factors influencing such properties.

The effectiveness of the alkyl- and hydroxy-substituted benzyl polyamines in controlling quick-heat intake manifold deposits was measured by the modified procedure for evaluating induction system deposits (ISD) described by Johnston and Dimitroff, SAE Transactions Vol.75 (1967) Paper No. 660,783. Good correlation between the results obtained by this procedure and the tendency of motor gasoline to form deposits in the induction system of sparkignition engines has been reported: Johnston and Stavinola, SAE Paper No. 690,758; Sheanhan, Iorer and Miller, SAE Paper No. 690,516.

The procedure consists of spraying gasoline and air onto a heated preweighted metal tube. At the conclusion of the test, the metal tube is removed from the apparatus, washed with heptane and weighed again. The weight of the deposit to the nearest 0.1 mg indicates the deposit-forming tendency of the fuel in the induction system. In the present series of tests, the fuel was industry-known Indolene which additionally contained 10 volume percent of Indolene distillation bottoms to increase the deposit-forming capability of the gasoline. A total of 100 ml of the fuel was used in each test run at a flow rate of 2ml/min. and an air flow of 0.5 cu. ft./min. The tests were carried out at 177° C in the view of the temperature recommendation of 121° to 204° C made in the paper by Bond concerning th quick-heat intake manifold: SAE Paper No. 720,935 (1974). The test results below are presented in terms of percent reduction in the deposit weight compared to the deposit weight obtained with the base fuel. A deposit weight reduction of at least 40% was used as the criterion for effective quick-heat intake manifold deposit control.

Alkyl- and hydroxy-substituted benzylpolyamines containing different numbers of benzyl groups were prepared from polypropylenephenol containing at least 60% of the polypropylene group in the p-position, formaldehye, and either triethylenetetramine or tetraethylenepentamine in molar proportions sufficient to give products having the structural formula $$ZNH-(C_2H_4N)_yC_2H_4NH-Z \quad (\text{with } R' \text{ on the N})$$

wherein R′ = H or Z, and

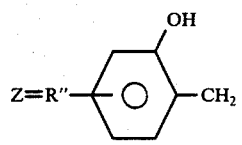

where R″ is polypropylene of 840mw.

The amount of additive employed was 20 pounds per thousand barrels. Test results are summarized in Table I and show that the polyamine component of the present composition should contain at least two Z groups for the control of quick-heat intake manifold deposits.

TABLE I

| y | No. of Z | Deposit Wt. Change % |
|---|---|---|
| 2 | 1 | −34 |
| 2 | 2 | −91 |
| 2 | 3 | −95 |
| 3 | 1 | −27 |
| 3 | 2 | −90 |
| 3 | 3 | −95 |

The following induction system deposit tests show that in addition to the presence of at least two Z groups, both the size of the alkyl group (number of carbon atoms) and the location of the alkyl group in Z (% para to the hydroxyl group) are important for the control of quick-heat intake manifold deposits. The polyamines used in this series of tests were derived from tetraethylenepentamine and contained two Z groups, the size and the location of the alkyl substituent in Z are as indicated. The criterion of at least 40% reduction of deposit weight for effective deposit control was used.

The same fuel, additive concentration, and temperature were employed as for the tests summarized in Table I. The additive was $ZNH(C_2H_4NH)_3C_2H_4NHZ$. These induction system deposit test are summarized in Table 2.

TABLE 2

| Size | Location (% Para) | Deposit Percent Weight |
|---|---|---|
| $C_4$ | 100 | + 106 |
| $C_9$ | 100 | + 31 |
| $C_{36}$ | 90 | + 3 |
| $C_{60}$ | 24 | −18 |
| $C_{60}$ | 57 | −35 |
| $C_{60}$ | 67 | −95 |
| $C_{60}$ | 80 | −90 |
| $C_{60}$ | 85 | −95 |

By plotting or by interpolation of the above data it can be seen that when two Z groups are present, the alkyl substituent in Z should have about 50 carbon atoms and at least 60% of the alkyl substituent should be located para to the hydroxyl group in order to achieve a reduction in deposit weight of at least 40%.

The requirement that at least one R′ be hydrogen in the polyamine component of the present composition assures satisfactory carburetor detergency. The carburetor detergency test (Onan) is carried out in a single cylinder engine to which a controlled amount of exhaust gas from another engine is mixed with air supplied to the test carburetor. The test carburetor throat consists of a two-piece stainless steel liner fitted around the throttle plate shaft. The liner is easily removed for inspection and rating. The engine is operated under cycling conditions of one minute idling and three minutes of part throttle for an overall test period of two hours. A visual rating scale (Onan Rating) of 10 for a clean carburetor and O for a very dirty carburetor is used. Generally, a rating of about 7 or greater is considered to indicate satisfactory carburetor detergency. Carburetor detergency test results are summarized in Table 3 for an additive concentration of 15 pounds per thousand barrels of $$ZNH(C_2H_4N)_yC_2H_4NH-Z \quad (\text{with } R' \text{ on the N})$$

where R′ = H or Z, and

Z = alkyl- and hydroxy-substituted benzyl groups where the alkyl group is polypropylene of 840 mw.

TABLE 3

| y | Polyamine No. of R′ = H | Onan Rating |
|---|---|---|
| 1 | 1 | 7.8 |
| 1 | 0 | 5.1 |
| 2 | 2 | 8.7 |
| 2 | 1 | 8.4 |
| 2 | 0 | 6.4 |
| 3 | 3 | 8.8 |
| 3 | 2 | 8.7 |
| 3 | 1 | 7.9 |
| 3 | 0 | 7.0 |

While the structural requirements explored in Tables 1, 2 and 3 are based on tests of polyamine (ii) component alone, it is to be expected that the same requirements would hold when polyamine (ii) is used in combination with diamine (i).

As heretofore explained, gasoline additives which are useful in providing carburetor detergency often provide increased deposit accumulation on the intake valves. Polyamine (ii) is an effective carburetor detergent. However, when it is used in gasoline in an amount effective to provide detergency, say, 10 to 20 pounds per thousand barrels (PTB), excessive intake valve deposit accumulation occurs. The characteristics of these polyamines are such that with increasing amounts of the polyamine in gasoline, intake valve deposits decrease; however, usage levels of 200 PTB or more are required to nullify the deposit-increasing characteristics of these materials. Of course, such high usage levels are impractical and uneconomical.

It has now been found that the combination of the diamine (i) of the formula set out in the "Summary" and the polyamine (ii) of the formula set out in the "Summary" provides excellent carburetor detergency and effective control of intake valve deposits as well. Additionally, when the preferred class of polyamine is used, that is, polyamines wherein at least 60% of the alkyl substituent in the Z groups is para to the hydroxyl group, effective quick-heat intake manifold deposit control is also obtained.

The invention composition can be prepared by combining, in any known manner, the diamine and the polyamine prepared separately, for example, by the Mannich reaction. The diamine and the polyamine can be combined as such or in the form of solutions thereof. The invention compositions can also be prepared directly by the Mannich reaction by reacting a mixture of diamine and polyamine as defined, with the alkylphenol and formaldehyde.

The hydrocarbon fuel to which the present invention composition is added to impart the desirable characteristics comprises gasoline or a mixture of hydrocarbons boiling in the gasoline range which is normally in the range of about 32° C. to 205° C. The base fuel can consist of straight chain or branched chain paraffins, cycloparaffins, olefins and aromatic compounds or any mixture of such hydrocarbons obtainable from straight run naphtha, polymer gasoline, natural gasoline, thermally or catalytically cracked hydrocarbon stocks and catalytically reformed stocks.

The gasoline can also contain conventional gasoline additives such as anti-knock compounds, dyes, antioxidants, anti-icing agents, rust inhibitors, detergents, anti-preignition agents, as well as intake valve deposit control additives such as nonvolatile lubricating mineral oils of 500 to 1500 SUS viscosity at 100° F., and low molecular weight polypropylenes and polybutylenes.

The efficiency of the individual components of the present invention compositions in controlling intake valve deposits was determined by the previously described induction system deposit (ISD) technique of Johnston and Dimitroff modified to simulate the environmental conditions in the vicinity of the intake valves in the modern engines. The tests were carried out at 288° C. using the industry-known Indolene as the fuel which contained 10 volume percent of 10% Indolene distillation bottoms and 0.05 volume percent of used (3300 miles) automotive crankcase oil ("Uniflo"). That the modified ISD technique as used herein realistically reflects the actual intake valve deposit accumulation in an engine is seen in the good correlation between the results obtained by this technique and the intake valve deposit accumulation in a 1973 Buick engine operated for 6000 miles on a programmed chasis dynamometer on the AMA City Driving Schedule (Fed. Reg. Vol. 33 No. 2 Jan. 1968).

Diamine (i)

The effects of the diamine on the induction system deposits were determined by adding the diamine in the indicated amounts to the above-described fuel and determining the amount of deposit formed in the above ISD tests. The diamine used was ethylenediamine having each of the nitrogen atoms substituted with an alkyl- and hydroxy-substituted benzyl group, the alkyl substituent being derived from polypropylene of 840 molecular weight. This diamine provides little or no carburetor detergency. This diamine was added to the fuel as a 75% by weight solution in toluene. The results are summarized below in Table 4 in terms of percent deposit weight change over that of the control fuel.

POLYAMINE (ii)

The effects of the polyamine on the induction system deposits were similarly determined. The polyamine was tetraethylenepentamine containing an alkyl- and hydroxy-substituted benzyl group on each of the terminal nitrogen atoms, the alkyl group being derived from polypropylene of 840 molecular weight. Other polyamines derived from diethylenetriamine, triethylenetetramine and pentaethylenehexamine show substantially the same effect on the deposit weights. These polyamines are very effective carburetor detergents. The results are also summarized in Table 4, wherein PTB is pounds per thousand barrels.

TABLE 4

| Additive (PTB) | ISD Deposit Test % Deposit Weight Change (i) | (ii) |
|---|---|---|
| 15 | +117 | +118 |
| 37.5 | +43 | +83 |
| 56.2 | +5 | — |
| 75 | −10 | +51 |
| 93.7 | — | +42 |
| 112.5 | −32 | +28 |
| 150 | −52 | +20 |

It will be noted from the above data that the characteristics of these additives appear to be a large increase in the deposit weights at a relatively low concentration with the deposit weights decreasing at higher concentrations. The data of the above table can be plotted e.g. percent deposit weight change versus additive concentration to obtain a "response curve" from which deposit weight change for other concentrations of the additive can be determined.

The following Examples illustrate the invention. In all of these Examples, the diamine (i) is ethylenediamine, $ZNHC_2H_4NHZ$, wherein the alkyl group of Z is derived from polypropylene of 840 molecular weight. The polyamine (ii) in all of the Examples is triethylenetetramine, $$ZNH(C_2H_4N(H))_2C_2H_4NHZ,$$

wherein the alkyl group in each Z is derived from polypropylene of 840 molecular weight.

EXAMPLES 1 to 6

These Examples show the effects of the present invention composition on the percent deposit weight change. The invention composition was added to the fuel as a 75% by weight solution in toluene to provide the indicated concentrations.

The results are summarized in Table 5 wherein the results obtained with the invention composition are compared with "percent deposit weight change, expected" determined from the expected contribution of the diamine and the polyamine individually as determined from the "response curve" described above. Thus, in Example 4 wherein the invention composition is used in such an amount that the diamine (i) is present at 50 PTB and the polyamine (ii) is present at 25 PTB, from the above-described response curves it can be determined that diamine (i) at 50 PTB should provide + 16% deposit weight change and polyamine (ii) at 25 PTB a + 100% deposit weight change, or a total expected percent deposit weight change of + 116%.

TABLE 5

| Example No. | ISD Deposit Tests: Additive Combination (i) | PTB | (ii) | Total PTB | % Deposit Weight Change: Expected | Found |
|---|---|---|---|---|---|---|
| 1 | 10 | + | 5 | 15 | +254 | +104 |
| 2 | 25 | + | 12.5 | 37.5 | +186 | +45 |
| 3 | 34.8 | + | 17.7 | 52.5 | +154 | +27 |
| 4 | 50 | + | 25 | 75 | +116 | +6 |
| 5 | 75 | + | 37.5 | 112.5 | +73 | −16 |
| 6 | 100 | + | 50 | 150 | +44 | −16 |

The above results show that the present invention compositions provide decreased deposit weight. The decreases are considerably greater than would be expected based on the expected individual contribution of the components. Thus, polyamine (ii) used in an amount which gives good carburetor detergency, say 25 PTB, provides an increase in the deposit weight of only 6% in the present invention composition (Example 4) instead of a deposit weight increase of 100% when used alone.

EXAMPLES 7 AND 8 AND COMPARISONS

These Examples show that the results of the ISD bench tests carried out as described show good correlation with intake valve deposit formation in a modern engine. The carburetor detergency of the invention compositions is also demonstrated.

Percent deposit weight change by ISD tests for diamine (i), polyamine (ii) and their combination, as well as the identities of these amines are described in the previous Examples. Intake valve deposit results were obtained in a 1973 455 CID Buick operated on a 6000 miles AMA City Driving Schedule on a programed chassis dynamometer (Federal Register Vol. 33 No. 2 January 4, 1968). Fuel used was industry-known Indolene containing 2 g./gal. of tetraethyllead. Intake valve deposit accumulation is given in terms of average percent deposit weight change compared to the average control weight which is about 2.1 g./valve.

The throttle plate and body of both the primary and the secondary sections of the carburetor were also visually inspected and rated on a scale of 1 to 10 where 1 designates dirty throttle plate and throttle body and 10 designates clean condition. The results are summarized in Table 6.

TABLE 6

| Example or Comparison | Additive PTB | Total Conc. PTB | % Deposit Weight Change: ISD Test | Buick Intake Valve | Carburetor Cleanliness (Detergency) Rating: Primary | Secondary |
|---|---|---|---|---|---|---|
| | None | — | 0 | 0 | 6 | 3 |
| Comp. A | 15(i) | 15 | +117 | +100 | 7 | 7 |
| Comp. B | 15(ii) | 15 | +118 | +113 | 10 | 10 |
| Ex. 7 | 10(i)+5(ii) | 15 | +104 | +65 | 10 | 9+ |
| Ex. 8 | 50(i)+25(ii) | 75 | +6 | +10 | 10 | 10 |

The results show there is good correlation between the results of the ISD test carried out as described and the results of the intake valve deposit engine test. The engine results also show, similarly to the ISD tests, that the present invention compositions provide for a greater decrease in intake valve deposits than would be expected from the effects upon the intake valves of the individual components. The carburetor detergency ratings show that the diamine has a slight detergency property whereas the invention compositions show carburetor detergency substantially the same as that of the efficient polyamine even though the polyamine is present at a much lower concentration (Example 7).

The embodiments of the invention in which an exclusive property or privilege is claimed are defined as follows:

1. A gasoline additive composition comprising a combination of i. from 60 to 75 weight percent of a diamine of the formula $ZNHC_nH_{2n}NHZ$, and ii. from 25 to 40 weight percent of a polyamine of the formula $Z—NH(C_xH_{2x}N(R'))_y—C_xH_{2x}NH—Z$ wherein Z is an alkyl- and hydroxy-substituted benzyl, the alkyl having 50 to 1000 carbon atoms; R' is hydrogen or Z with the proviso that at least one R' is hydrogen; $n$ is 2 to 6; $x$ is 2 or 3; and $y$ is 1 to 5.

2. A composition according to claim 1 wherein Z has 50 to 200 carbon atoms.

3. A composition according to claim 2 wherein the alkyl in Z has 50 to 75 carbon atoms and wherein in Z at least 60% of the alkyl substituent is para to the hydroxyl substituent.

4. A composition according to claim 3 wherein $n$ is 2, $x$ is 2 and $y$ is 1 to 4.

5. A composition according to claim 4 wherein y is 2 or 3 and wherein each R' is hydrogen.

6. A composition according to claim 1 wherein (i) is $ZNHC_2H_4NHZ$, and (ii) is $ZNH(C_2H_4N(R'))_y C_2H_4NHZ$ wherein $y$ is 2 or 3.

7. A composition according to claim 6 wherein $y$ is 2.

8. A composition according to claim 6 wherein $y$ is 3.

9. A gasoline composition containing from 0.004 to 0.1 weight percent of the composition of claim 1.

10. A solution of the composition of claim 1 in a hydrocarbon solvent that boils in the gasoline boiling range.

* * * * *